US010619390B2

(12) United States Patent
Suesada et al.

(10) Patent No.: US 10,619,390 B2
(45) Date of Patent: Apr. 14, 2020

(54) HINGE MECHANISM

(71) Applicant: HONDA MOTOR CO., LTD., Tokyo (JP)

(72) Inventors: Ryo Suesada, Wako (JP); Masatoshi Mori, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/228,253

(22) Filed: Dec. 20, 2018

(65) Prior Publication Data

US 2019/0194989 A1 Jun. 27, 2019

(30) Foreign Application Priority Data

Dec. 22, 2017 (JP) ..... 2017-246368

(51) Int. Cl.
*E05D 5/06* (2006.01)
*E05D 3/02* (2006.01)

(52) U.S. Cl.
CPC ..... *E05D 5/062* (2013.01); *E05D 3/02* (2013.01); *E05Y 2900/531* (2013.01)

(58) Field of Classification Search
CPC . Y10T 16/557; Y10T 16/558; Y10T 16/5595; Y10T 16/55988; E05D 3/02; E05D 5/121; E05D 5/04; E05D 5/043; E05D 5/06; E05D 5/062; E05D 11/06; E05D 7/1044; E05D 7/121; E05D 2005/102; E05Y 2201/632; E05Y 2900/50; E05Y 2900/531; B60J 5/047
See application file for complete search history.

(56) References Cited

U.S. PATENT DOCUMENTS 1,164,857 A * 12/1915 Parsons ..... E05D 11/06 16/374
1,598,163 A * 8/1926 Soss ..... E05D 3/02 16/270

(Continued)

FOREIGN PATENT DOCUMENTS

DE 3128068 A1 * 2/1983 ..... E05D 11/06
JP 2004-036229 A 2/2004

(Continued)

OTHER PUBLICATIONS

Japanese Office Action dated Jun. 4, 2019 (4 pages).

*Primary Examiner* — Chuck Y Mah
(74) *Attorney, Agent, or Firm* — Rankin, Hill & Clark LLP

(57) ABSTRACT

A hinge mechanism has: a structure side hinge member including a first attachment portion and a second attachment portion, wherein the structure side hinge member is attached to a structural body via the first attachment portion and the second attachment portion; an opening and closing side hinge member attached to an opening and closing body; and a pivot structure that pivotably supports the structure side hinge member and the opening and closing side hinge member so that the structure side hinge member and the opening and closing side hinge member are allowed to pivot relative to each other. The structure side hinge member is made of a single plate-like member. The pivot structure is located between the first attachment portion and the second attachment portion.

18 Claims, 8 Drawing Sheets

(56) References Cited

U.S. PATENT DOCUMENTS

| | | | | | |
|---|---|---|---|---|---|
| 2,163,713 | A * | 6/1939 | Soss | E05D 3/02 | 16/379 |
| 2,177,294 | A * | 10/1939 | Soss | E05D 3/02 | 16/379 |
| 2,215,088 | A * | 9/1940 | Soss | E05D 3/02 | 16/379 |
| 6,718,596 | B2 * | 4/2004 | Kohlstrand | E05D 5/062 | 16/235 |
| 8,505,164 | B2 * | 8/2013 | Katou | E05D 5/062 | 16/273 |
| 9,551,176 | B2 * | 1/2017 | Sasa | E05D 3/02 | |
| 9,863,175 | B2 * | 1/2018 | Murray | E05D 5/062 | |
| 10,184,280 | B2 * | 1/2019 | Rahman | E05D 3/02 | |
| 2008/0092332 | A1 * | 4/2008 | Lowen | E05D 5/00 | 16/221 |
| 2008/0295290 | A1 | 12/2008 | Murray et al. | | |
| 2011/0035906 | A1 * | 2/2011 | Esaki | E05D 3/02 | 16/374 |
| 2017/0321463 | A1 * | 11/2017 | Morinaga | B21D 53/88 | |

FOREIGN PATENT DOCUMENTS

| | | | | | |
|---|---|---|---|---|---|
| JP | 2012219499 | A * | 11/2012 | E05D 5/062 | |
| JP | 2014034855 | A * | 2/2014 | E05D 5/062 | |
| JP | 5479619 | B2 | 4/2014 | | |
| JP | 2015-048651 | A | 3/2015 | | |

* cited by examiner

HINGE MECHANISM

CROSS-REFERENCE TO RELATED APPLICATIONS

The present application claims priority under 35 U.S.C. § 119 to Japanese Patent Application No. 2017-246368, filed Dec. 22, 2017, the contents of which are hereby incorporated by reference in their entirety.

BACKGROUND OF THE INVENTION

1. Field of the Invention

The present invention relates to a hinge mechanism that pivotably supports an opening and closing body such as a door.

2. Description of Related Art

When an opening is opened or closed by an opening and closing body such as a door, a hinge mechanism is conventionally used to pivotably support the opening and closing body.

For example, the hinge mechanism proposed in Japanese Patent No. 5479619 has a vehicle body side hinge member, a door side hinge member, and a hinge pin that supports the vehicle body side hinge member and the door side hinge member in such a way that the vehicle body side hinge member and the door side hinge member are allowed to pivot relative to each other. In this hinge mechanism, the vehicle body side hinge member is made up of separate two members to improve the manufacturing yield of the vehicle body side hinge member.

SUMMARY OF THE INVENTION

Problem to be Solved by Invention

When the vehicle body side hinge member is made up of separate two members, steps for joining or the like are necessitated to ensure rigidity of the two members, resulting in an increase in the number of manufacturing steps.

The present invention has been made in view of the above-described problem, and it is an object of the present invention to provide a hinge mechanism that can prevent an increase in the number of manufacturing steps.

Solution to Problem

To accomplish the above-described object, a hinge mechanism according to the present invention has: a structure side hinge member including a first attachment portion and a second attachment portion, wherein the structure side hinge member is attached to a structural body via the first attachment portion and the second attachment portion; an opening and closing side hinge member attached to an opening and closing body; and a pivot structure that pivotably supports the structure side hinge member and the opening and closing side hinge member so that the structure side hinge member and the opening and closing side hinge member are allowed to pivot relative to each other. The structure side hinge member is made of a single plate-like member. The pivot structure is located between the first attachment portion and the second attachment portion.

Advantageous Effect of the Invention

The present invention provides a hinge mechanism that can prevent an increase in the number of manufacturing steps.

DETAILED DESCRIPTION OF EMBODIMENTS

Hereinafter, a first embodiment of the present invention will be described in detail with reference to the drawings appropriately. The same reference signs denote the same constituent elements, and duplicative descriptions will be omitted.

Figure 1:
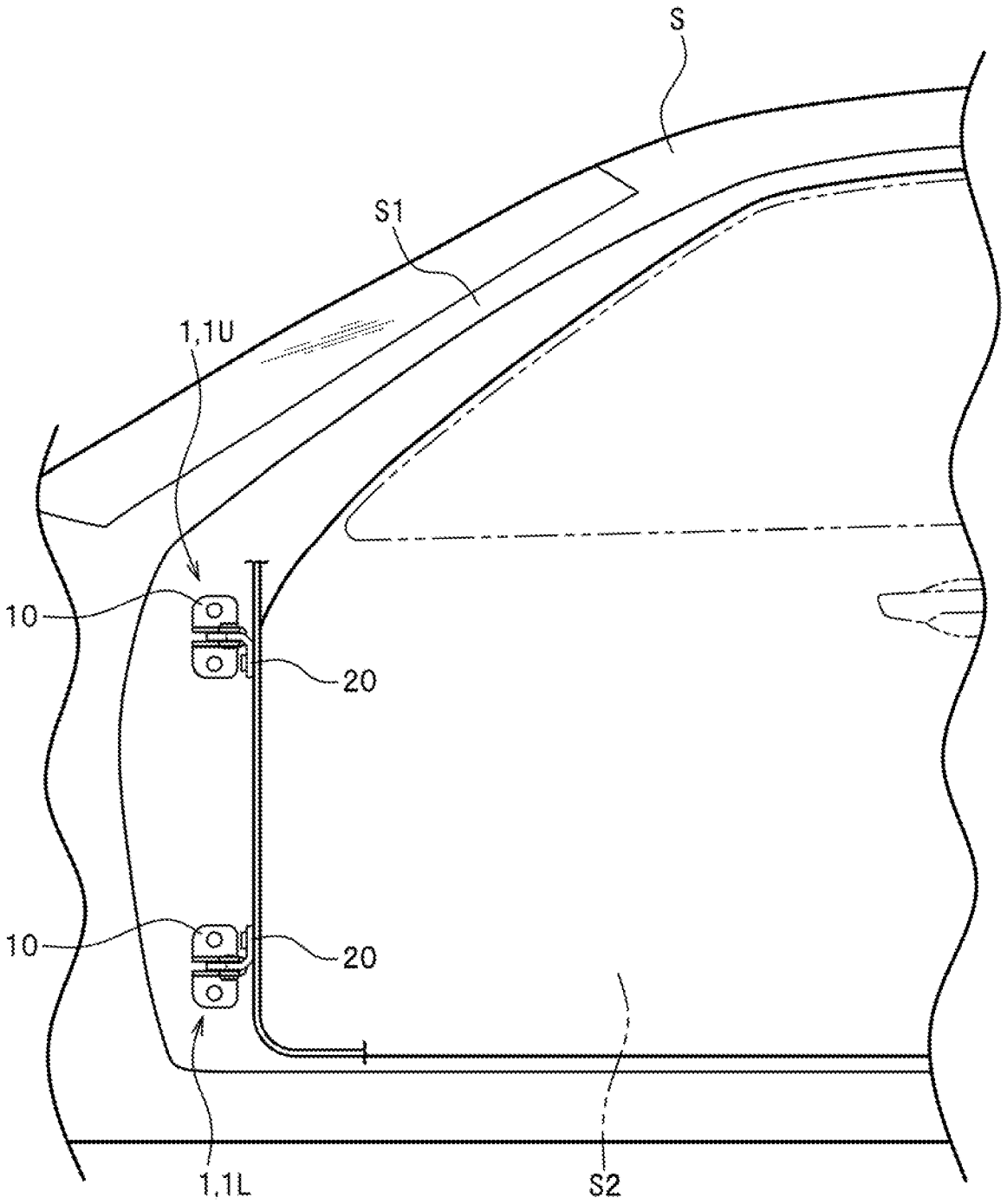
FIG. 1 is a side view showing a vehicle to which a hinge mechanism according to a first embodiment is attached.

As shown in FIG. 1, a hinge mechanism 1 of the present embodiment is attached to a side surface of a vehicle body S (structural body). The vehicle body S has a door opening S1 (vehicle opening) on the side surface of the vehicle body S. The door opening S1 is opened or closed by a door S2 (opening and closing body).

The door S2 is supported by the vehicle body S, pivotably about the hinge mechanism 1 disposed on a front side of the door S2. The door S2 is fitted into the door opening S1 of the vehicle body S to close the door opening S1.

Figure 2:
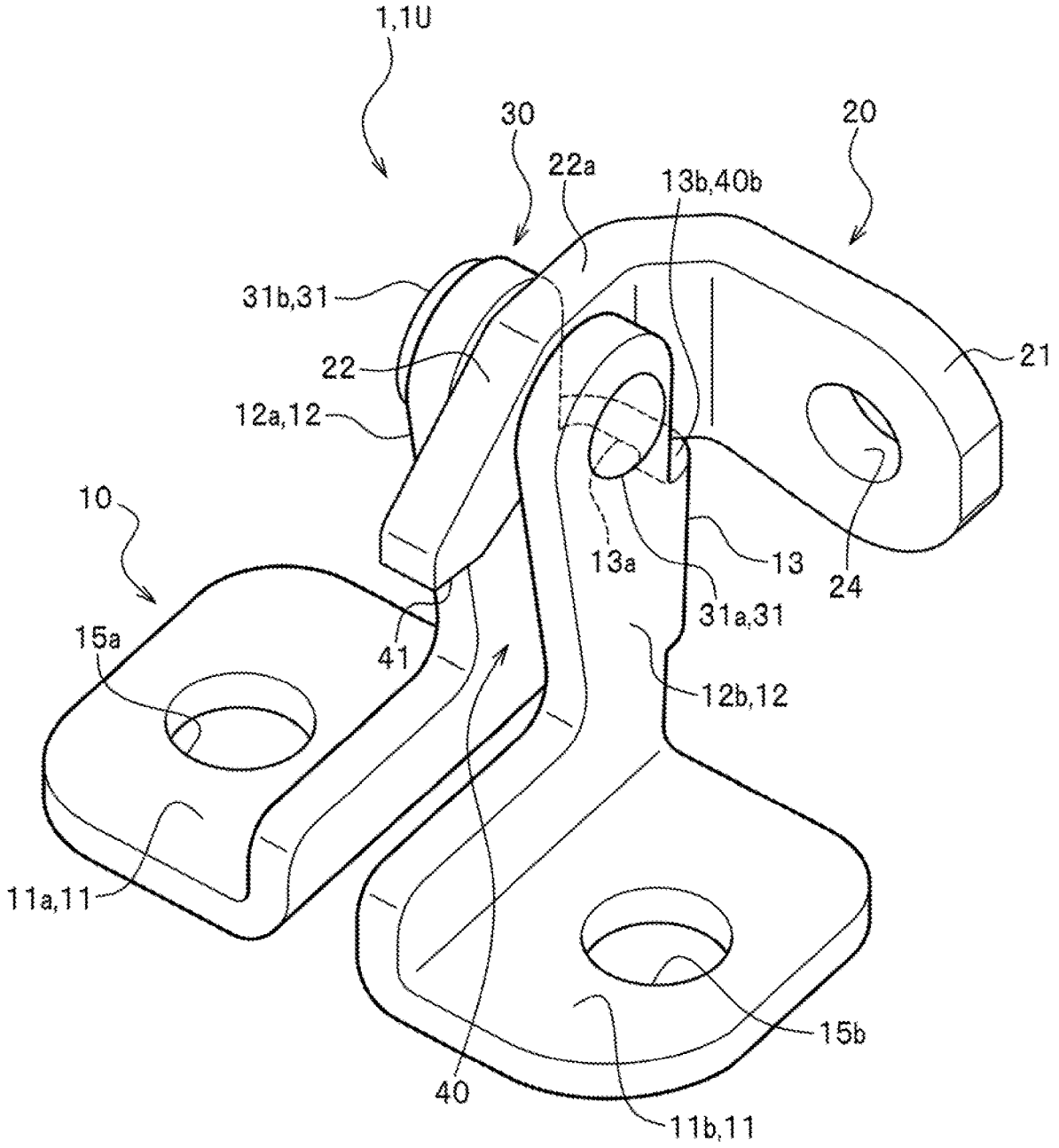
FIG. 2 is a perspective view showing an upper hinge mechanism according to the first embodiment.
Figure 3:
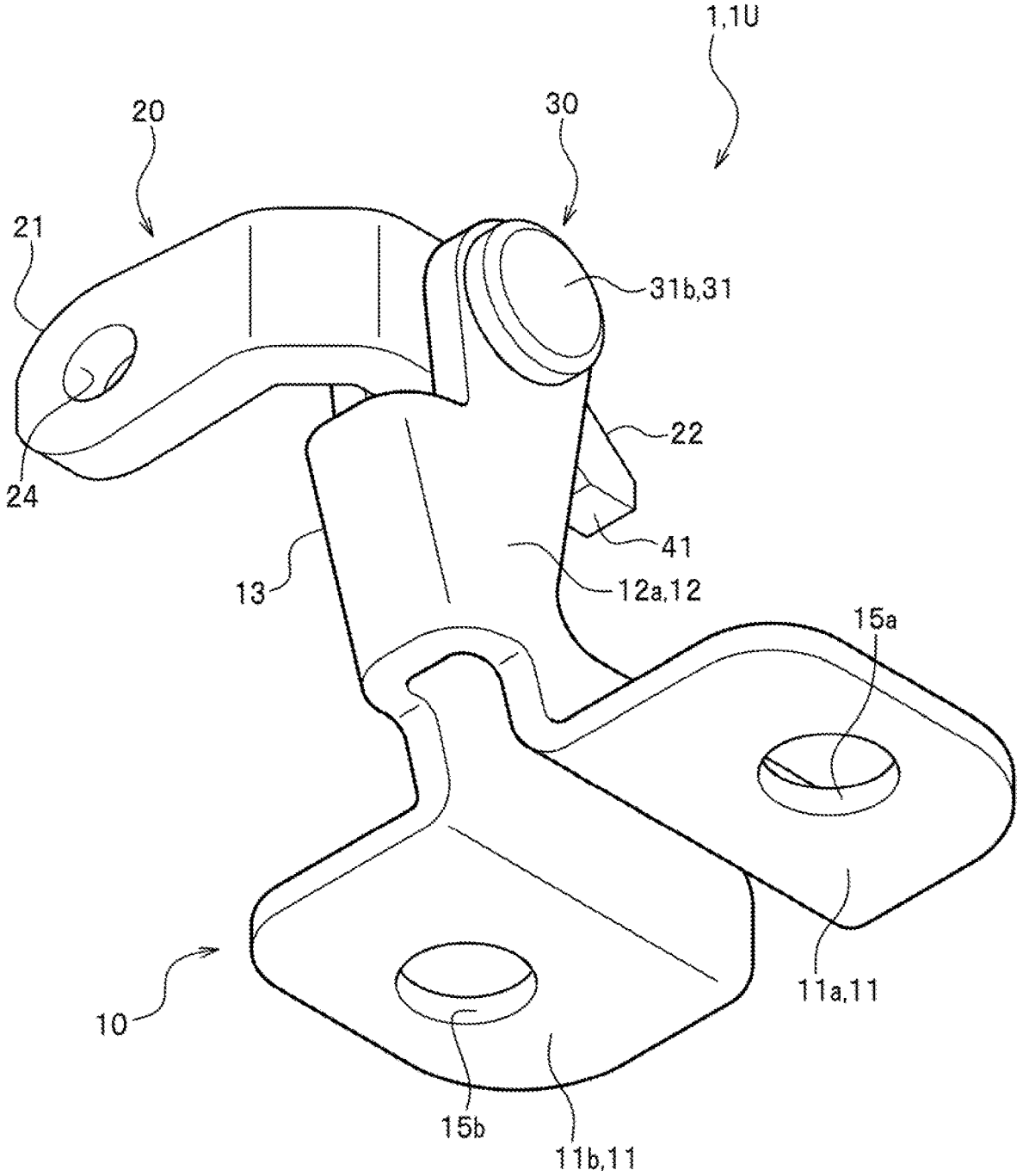
FIG. 3 is a perspective view of the upper hinge mechanism seen in the opposite view direction against the view direction of FIG. 2.

As shown in FIG. 1, the hinge mechanism 1 of the present embodiment is disposed on upper and lower sides of a front end of the door. As shown in FIGS. 2 and 3, the hinge mechanism 1 is made up of a vehicle body side hinge member 10 (structure side hinge member), a door side hinge member 20 (opening and closing side hinge member), and a hinge pin 31. The vehicle body side hinge member 10 and the door side hinge member 20 together define a pivot structure 30 and a pivot restricting structure 40.

Figure 5:
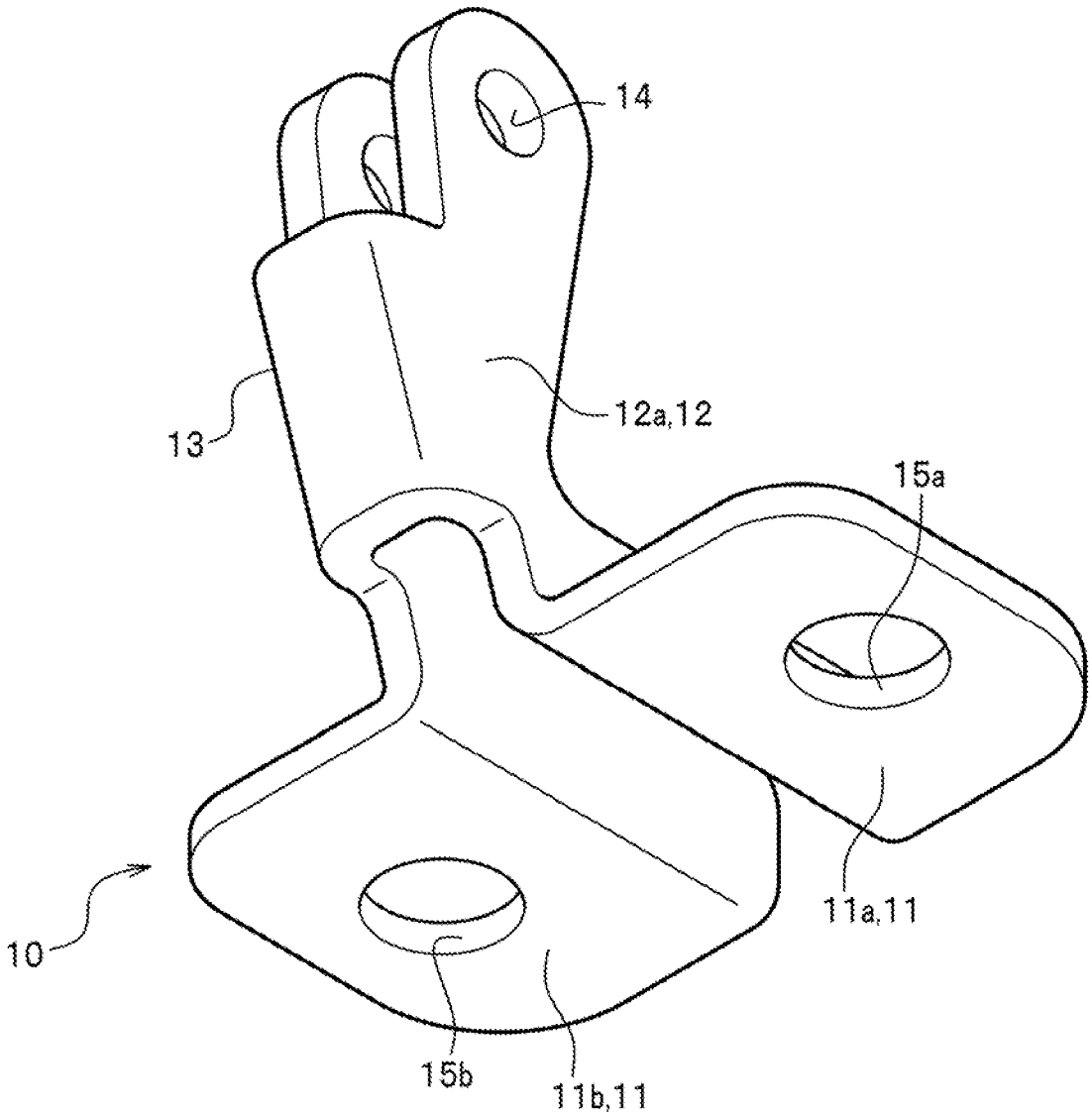
FIG. 5 is a perspective view of a structure side hinge member of the hinge mechanism according to the first embodiment.
Figure 6A:
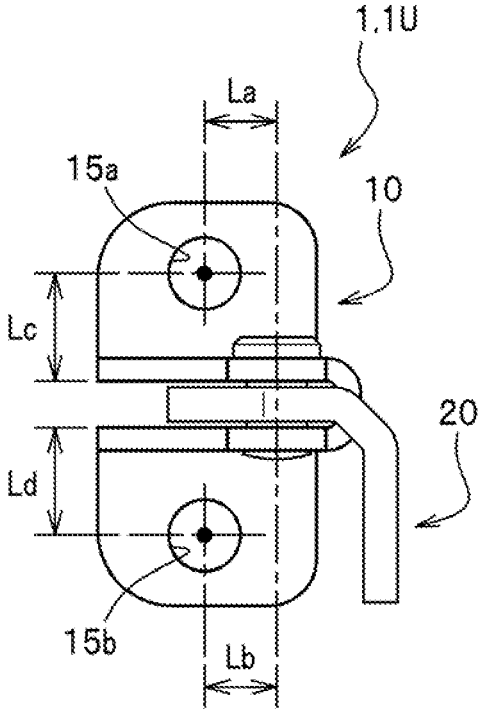
FIG. 6A is a plan view of the upper hinge mechanism according to the first embodiment.
Figure 6B:
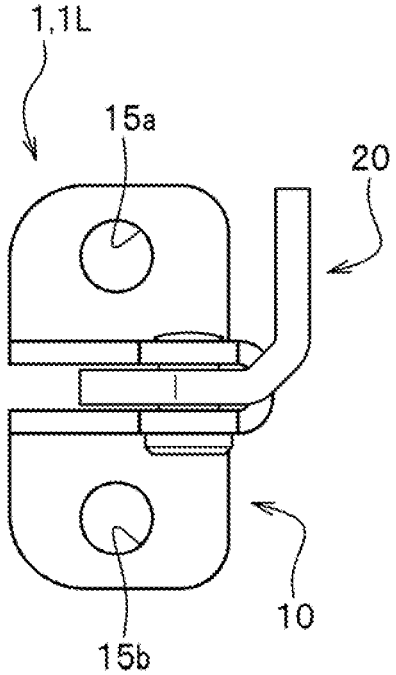
FIG. 6B is a plan view of a lower hinge mechanism according to the first embodiment.

As shown in FIGS. 1 and 6, the hinge mechanism 1 on the upper side, hereafter referred to as a hinge mechanism 1U, and the hinge mechanism 1 on the lower side, hereafter referred to as a hinge mechanism 1L, are made up of the same members as each other except the door side hinge member 20 (opening and closing side hinge member). Therefore, the constituent elements of the hinge mechanism 1 will be described with reference to FIGS. 2 to 5, each of which shows the upper hinge mechanism 1U.

Figure 4:
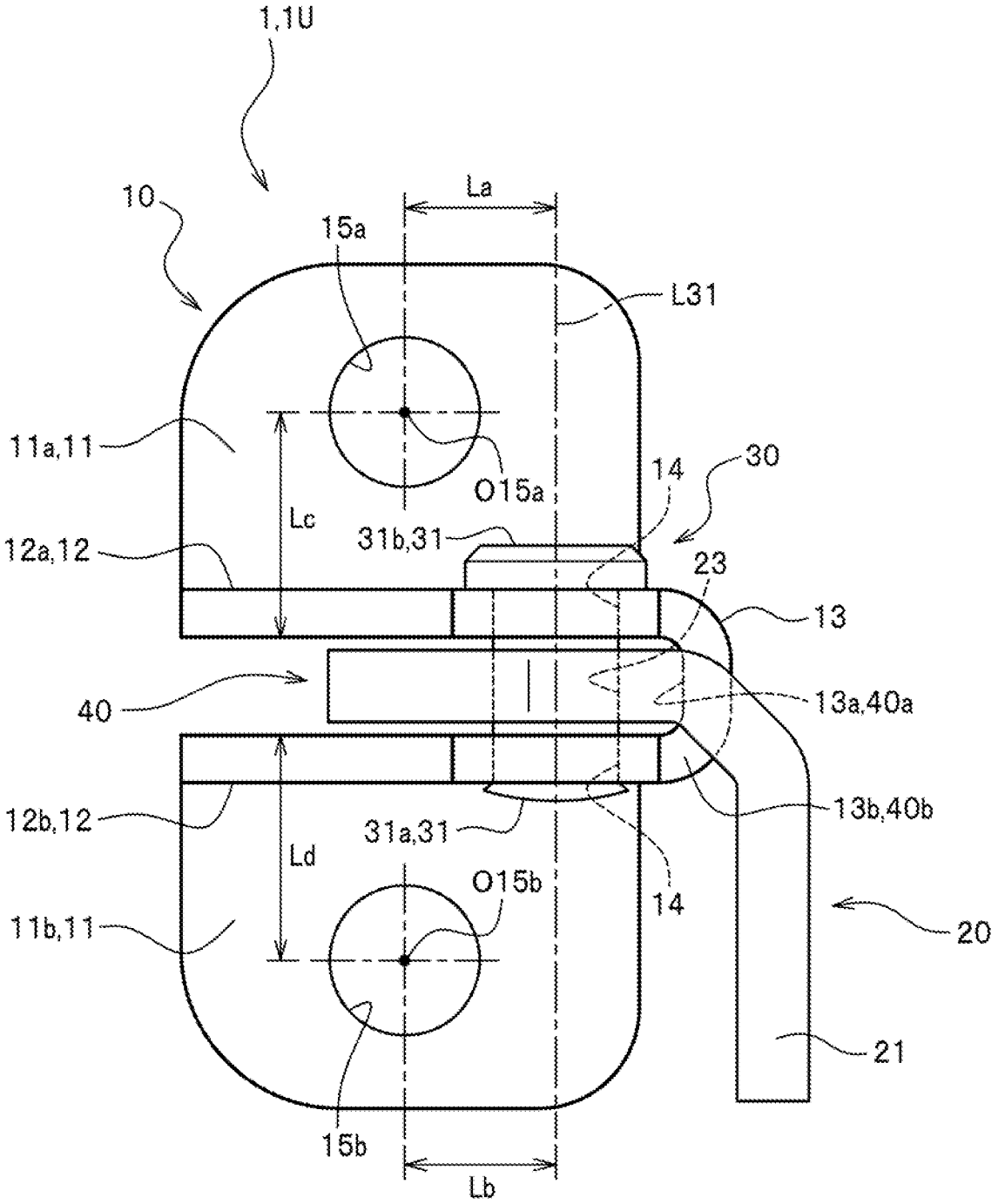
FIG. 4 is a plan view showing the upper hinge mechanism according to the first embodiment.

As shown in FIG. 1, as a structure side hinge member, the vehicle body side hinge member 10 is attached to an outer surface of a front edge portion of the door opening S1. As shown in FIGS. 2 to 4, the vehicle body side hinge member 10 is a single plate-like metal member formed by press working, and includes a vehicle body side attachment section 11, a standing leg section 12, a connection portion 13, and a vehicle body side pivot portion 14 (structure side pivot portion). The vehicle body side attachment section 11 is made up of a vehicle body side upper attachment portion 11*a* (first attachment portion) and a vehicle body side lower attachment portion 11*b* (second attachment portion). The vehicle body side upper attachment portion 11*a* and the vehicle body side lower attachment portion 11*b* each have a substantially rectangular shape with rounded corners and are spaced apart from each other on the same plane so that their lengthwise sides are opposite to each other and in parallel with each other.

The vehicle body side upper attachment portion 11*a* has a center portion in which an opening of an upper fixing hole 15*a* (first fixing means) is formed. The upper fixing hole 15*a* is a through-hole through which a vehicle body fastening bolt (not shown) is inserted. The vehicle body side lower attachment portion 11*b* has a center portion in which an opening of a lower fixing hole 15*b* (second fixing means) is formed. The lower fixing hole 15*b* is a through-hole through which a vehicle body fastening bolt is inserted.

The upper fixing hole 15*a* and the lower fixing hole 15*b* are located so that, as to the location in the left-right direction on the drawing plane of FIG. 4, a distance La from a center O15*a* of the upper fixing hole 15*a* to a hinge axis L31 of the hinge pin 31 described later is the same as a distance Lb from a center O15*b* of the lower fixing hole 15*b* to the hinge axis L31. In addition, as to the location in the up-down direction on the drawing plane of FIG. 4, a distance Lc from the center O15*a* of the upper fixing hole 15*a* to the lower lengthwise side of the rectangular shape of the vehicle body side upper attachment portion 11*a* is the same as a distance Ld from the center O15*b* of the lower fixing hole 15*b* to the upper lengthwise side of the rectangular shape of the vehicle body side lower attachment portion 11*b*.

The upper fixing hole 15*a* and the lower fixing hole 15*b* are formed to have the same diameter.

The standing leg section 12 is made up of: an upper standing leg portion 12*a*, which extends at a substantially right angle from the vehicle body side upper attachment portion 11*a*; and a lower standing leg portion 12*b*, which extends at a substantially right angle from the vehicle body side lower attachment portion 11*b*.

The upper standing leg portion 12*a* extends from the lower lengthwise side of the rectangular shape of the vehicle body side upper attachment portion 11*a* in a direction perpendicular to a plate surface of the vehicle body side upper attachment portion 11*a*.

The lower standing leg portion 12*b* extends from the upper lengthwise side of the rectangular shape of the vehicle body side lower attachment portion 11*b* in a direction perpendicular to a plate surface of the vehicle body side lower attachment portion 11*b*.

Thus, the upper standing leg portion 12*a* and the lower standing leg portion 12*b* are arranged in parallel with each other. The upper standing leg portion 12*a* and the lower standing leg portion 12*b* are spaced from each other by a distance such that a later-described pivot arm 22 of the door side hinge member 20 is smoothly pivotable without rattling.

The upper standing leg portion 12*a* and the lower standing leg portion 12*b* each have the same shape of a substantially L shape. The horizontal side of the L-shape of the upper standing leg portion 12*a* is continuously connected to the lower lengthwise side of the rectangular shape of the vehicle body side upper attachment portion 11*a*. Similarly, the horizontal side of the L-shape of the lower standing leg portion 12*b* is continuously connected to the upper lengthwise side of the rectangular shape of the vehicle body side lower attachment portion 11*b*. The vertical side the L-shape of the upper standing leg portion 12*a* and the vertical side the L-shape of the lower standing leg portion 12*b* are connected to each other via the connection portion 13.

Each of the upper standing leg portion 12*a* and the lower standing leg portion 12*b* has, at the tip portion of the vertical side of the L-shape thereof, the vehicle body side pivot portion 14 (structure side pivot portion) defining a through-hole.

The connection portion 13 has been bent by press working to have a substantially U-shaped cross section. The connection portion 13 has a U-shaped inner surface 13*a* that serves as a structural portion of an opening side pivot restricting structure 40*a* described later. The connection portion 13 has a tip side end surface 13*b* that serves as a structural portion of a closing side pivot restricting structure 40*b* described later.

The hinge pin 31 described later is inserted in the vehicle body side pivot portion 14 (structure side pivot portion) without rattling, by working such as press fitting and crimping.

A workpiece to be formed into the vehicle body side hinge member 10 is punched out from a base material (not shown) by press-working in a developed shape.

After that, the workpiece is bent along a border portion between the connection portion 13 and the upper standing leg portion 12*a* and along a border portion between the connection portion 13 and the lower standing leg portion 12*b* so that the upper standing leg portion 12*a* and the lower standing leg portion 12*b* are arranged in parallel with each other (see FIG. 5).

Next, the workpiece is bent along a border portion between the vehicle body side upper attachment portion 11*a* and the upper standing leg portion 12*a* and along a border portion between the vehicle body side lower attachment portion 11*b* and the lower standing leg portion 12*b* so that the vehicle body side upper attachment portion 11*a* and the vehicle body side lower attachment portion 11*b* are in the same plane.

With the above described steps, the vehicle body side hinge member 10 is formed.

Next, a description will be given of the door side hinge member 20.

As shown in FIG. 1, the door side hinge member 20 is attached as an opening and closing side hinge member to a front end surface of a front end portion of the door. The door side hinge member 20 is made of a plate-like metal member formed by press working to have a substantially L shape. The door side hinge member 20 includes a door side attachment portion 21, a pivot arm 22, and a door side pivot portion 23 (opening and closing side pivot portion) (see FIGS. 2 to 4).

In the upper hinge mechanism 1U, the door side hinge member 20 is arranged so that the door side attachment portion 21 hangs down from the pivot arm 22. In the lower hinge mechanism. 1L, the door side hinge member 20 is arranged so that the door side attachment portion 21 extends upward from the pivot arm 22. The door side attachment portion 21 has a rectangular shape with rounded corners as shown in FIGS. 2 and 3. The door side attachment portion 21 has an opening of a door fixing hole 24 defining a through-hole. The door side attachment portion 21 is fixed to the front end surface of the door S2 with a bolt (not shown) which passes through the door fixing hole 24 to threadedly engage with the door S2.

The pivot arm 22 is interposed between the upper standing leg portion 12*a* and the lower standing leg portion 12*b* with no gap therebetween, slidably along plate surfaces of the pivot arm 22. The pivot arm 22 has a door side pivot portion 23 (opening and closing side pivot portion) which is a through-hole defining an opening.

The hinge pin 31 is inserted through the door side pivot portion 23 to be pivotable about the axis thereof without rattling.

Next, a description will be given of the pivot structure 30.

The pivot structure 30 is made up of the pair of vehicle body side pivot portions 14 having openings in the upper standing leg portion 12*a* and the lower standing leg portion 12*b* of the vehicle body side hinge member 10, the door side pivot portion 23 of the door side hinge member 20, and the hinge pin 31.

The pivot structure 30 is located between the vehicle body side upper attachment portion 11*a* and the vehicle body side lower attachment portion 11*b*.

The hinge pin 31 includes: an axial portion 31*a* with a cylindrical column shape; and a head portion 31*b* formed on one end of the axial portion 31*a* and having a diameter larger than that of the axial portion 31*a*.

The hinge pin 31 is crimped to the pair of vehicle body side pivot portions 14 by enlarging the diameter of a tip end of the axial portion 31*a* in a state that the axial portion 31*a* is inserted through the upper standing leg portion 12*a*, the pivot arm 22, and the lower standing leg portion 12*b* in this order and the head portion 31*b* abuts onto the upper standing leg portion 12*a*.

That is, the hinge pin 31 passes through the door side hinge member 20, and the opposite ends of the hinge pin 31 are fixed to and supported by the upper standing leg portion 12*a* and the lower standing leg portion 12*b*.

With this structure, the hinge pin 31 is fixed to the upper standing leg portion 12*a* and the lower standing leg portion 12*b*, and pivotably supports the pivot arm 22.

Next, a description will be given of the pivot restricting structure 40.

The pivot restricting structure 40 is a structure for defining a range of opening to closing of the door S2. The pivot restricting structure 40 has an opening side pivot restricting structure 40*a* and a closing side pivot restricting structure 40*b*.

The opening side pivot restricting structure 40*a* defines a pivoting end for opening the door S2. The opening side pivot restricting structure 40*a* is made up of: an engaging portion 41 of the pivot arm 22 that extends toward a tip end thereof relative to the door side pivot portion 23; and the U-shaped inner surface 13*a* of the connection portion 13.

The above-described connection portion 13 has a shape such that the connection portion 13 traverses the pivoting range of the door side hinge member 20. With this structure of the opening side pivot restricting structure 40*a*, when the door side hinge member 20 pivots in a direction of opening, a tip end of the engaging portion 41 abuts on the inner surface of the connection portion 13 to restrict the pivoting of the pivot arm 22.

The closing side pivot restricting structure 40*b* defines a pivoting end for closing the door S2. The closing side pivot restricting structure 40*b* is made up of: a base portion 22*a* of the pivot arm 22 that is located on a base side (bent portion side) thereof relative to the door side pivot portion 23; and the tip side end surface 13*b* of the connection portion 13.

As described above, the connection portion 13 has a shape such that the connection portion 13 traverses the pivoting range of the door side hinge member 20. With this structure of the closing side pivot restricting structure 40*b*, when the door side hinge member 20 pivots in a direction of closing, the base portion 22*a* of the pivot arm 22 abuts on the tip side end surface 13*b* of the connection portion 13, to restrict the pivoting of the pivot arm 22.

Further, with this structure of the closing side pivot restricting structure 40*b*, when a collision occurs to a side of the vehicle, the collision load is received not only by the pivot structure 30 but also by the closing side pivot restricting structure 40*b*. This allows the vehicle to bear a large collision load.

Next, a description will be given of advantageous effects of the hinge mechanism 1 according to the present embodiment.

In the present embodiment, the vehicle body side hinge member 10 (structure side hinge member) is made of a single plate-like member on which bending work has been performed. Thus, the vehicle body side upper attachment portion 11*a* (first attachment portion) and the vehicle body side lower attachment portion 11*b* (second attachment portion) are formed of a single member.

This structure prevents an increase in the number of manufacturing steps because it allows for eliminating steps of joining and/or plate matching which are necessary when the vehicle body side upper attachment portion 11*a* and the vehicle body side lower attachment portion 11*b* are respectively formed of separate members.

In the present embodiment, the pivot structure 30 is located between the vehicle body side upper attachment portion 11*a* and the vehicle body side lower attachment portion 11*b*.

With this structure, as the opposite sides of the pivot structure 30 are supported, the vehicle body side hinge member 10 is stably attached to the vehicle body S.

In the present embodiment, the hinge pin 31 passes through the door side hinge member 20 (opening and closing side hinge member), and the opposite ends of the hinge pin 31 are supported by the upper standing leg portion 12*a* (first standing leg portion) that extends at a substantially right angle from the vehicle body side upper attachment portion 11*a* (first attachment portion) and the lower standing leg portion 12*b* (second standing leg portion) that extends at a substantially right angle from the vehicle body side lower attachment portion 11*b* (second attachment portion).

This structure allows for pivotably supporting the door side hinge member 20 between the upper standing leg portion 12*a* and the lower standing leg portion 12*b*, thus allows the door side hinge member 20 to pivot in a stable manner.

In the present embodiment, the connection portion 13 traverses the pivoting range of the door side hinge member 20 and connects between the upper standing leg portion 12*a* and the lower standing leg portion 12*b*. On the other hand, the door side hinge member 20 includes the engaging portion 41 that is abuttable against the connection portion 13, with the door side hinge member 20 being at a full-open position.

With this structure, a pivoting range of the door S2 (opening and closing body) on the opening side thereof is defined without an additional member, and the pivoting range can be changed by only changing the shape of the engaging portion 41.

In the present embodiment, in plan view as shown in FIG. 4, the upper fixing hole 15*a* and the lower fixing hole 15*b* are located so that the distance La from the hinge axis L31 (central axis of hinge pin 31) to the center O15*a* of the upper fixing hole 15*a* (first fixing means) is the same as the distance Lb from the hinge axis L31 to the center O15*b* of the lower fixing hole 15*b* (second fixing means).

This structure can prevent imbalance in the load applied to the pivot structure 30. This allows for supporting the vehicle body side hinge member 10 in a stable manner and allows for smooth pivoting in the pivot structure 30.

It should be noted that, although the distances La and Lb are set to a predetermined non-zero dimension, they are not limited thereto.

Figure 8:
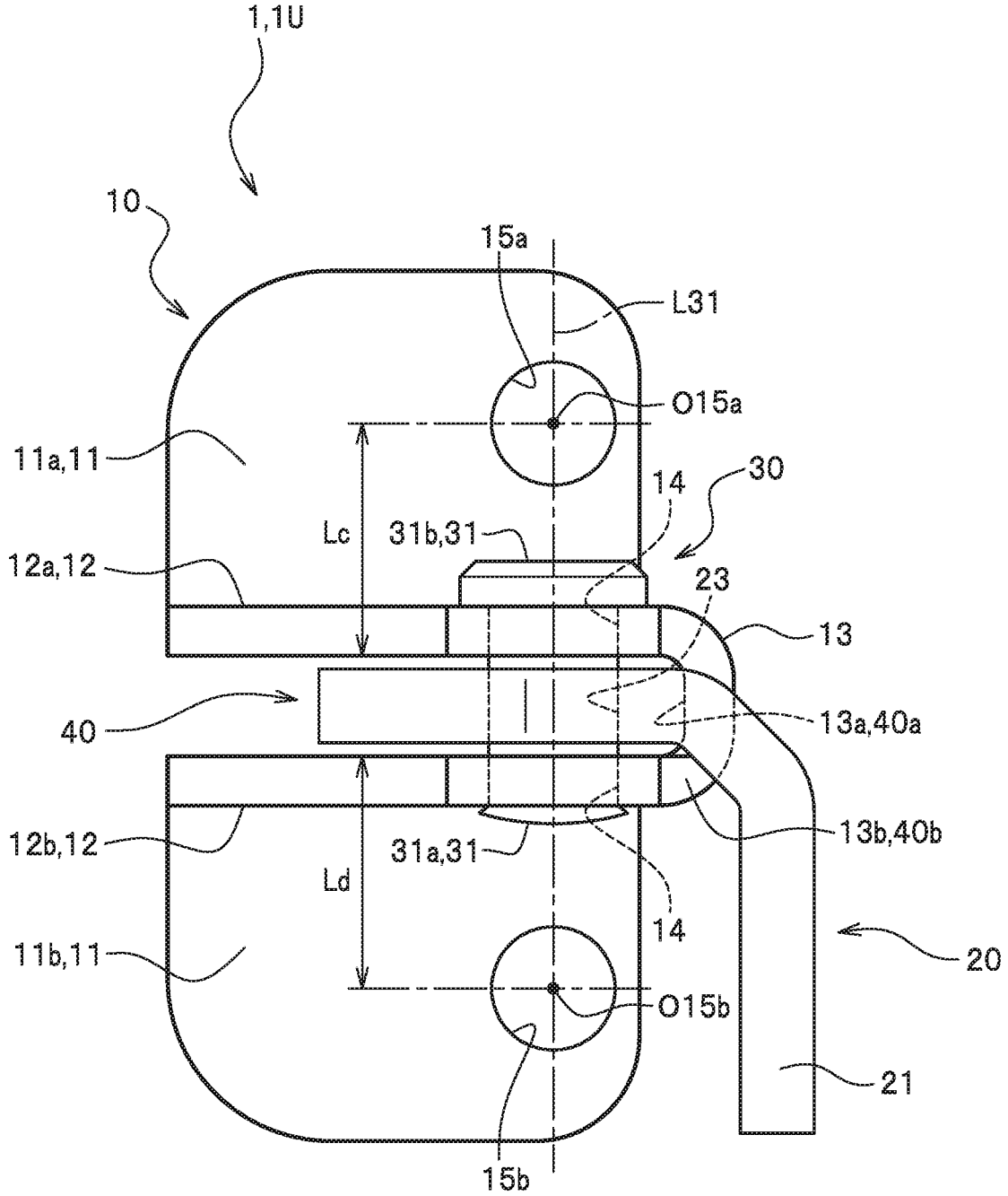
FIG. 8 is a plan view of an upper hinge mechanism of a modification of the first embodiment.

The distances La and Lb may both be set to 0 (zero). That is, in plan view as shown in FIG. 8, the upper fixing hole 15*a* and the lower fixing hole 15*b* can be located so that the center O15*a* of the upper fixing hole 15*a* and the center O15*b* of the lower fixing hole 15*b* are both on the hinge axis L31.

Even such a configuration allows for supporting the vehicle body side hinge member 10 in a stable manner and allows for smooth pivoting in the pivot structure 30.

Next, a description will be given of a second embodiment of the present invention.

The same constituent elements as those of the above-described hinge mechanism 1 are given the same reference signs, and duplicative descriptions will be omitted.

Figure 7:
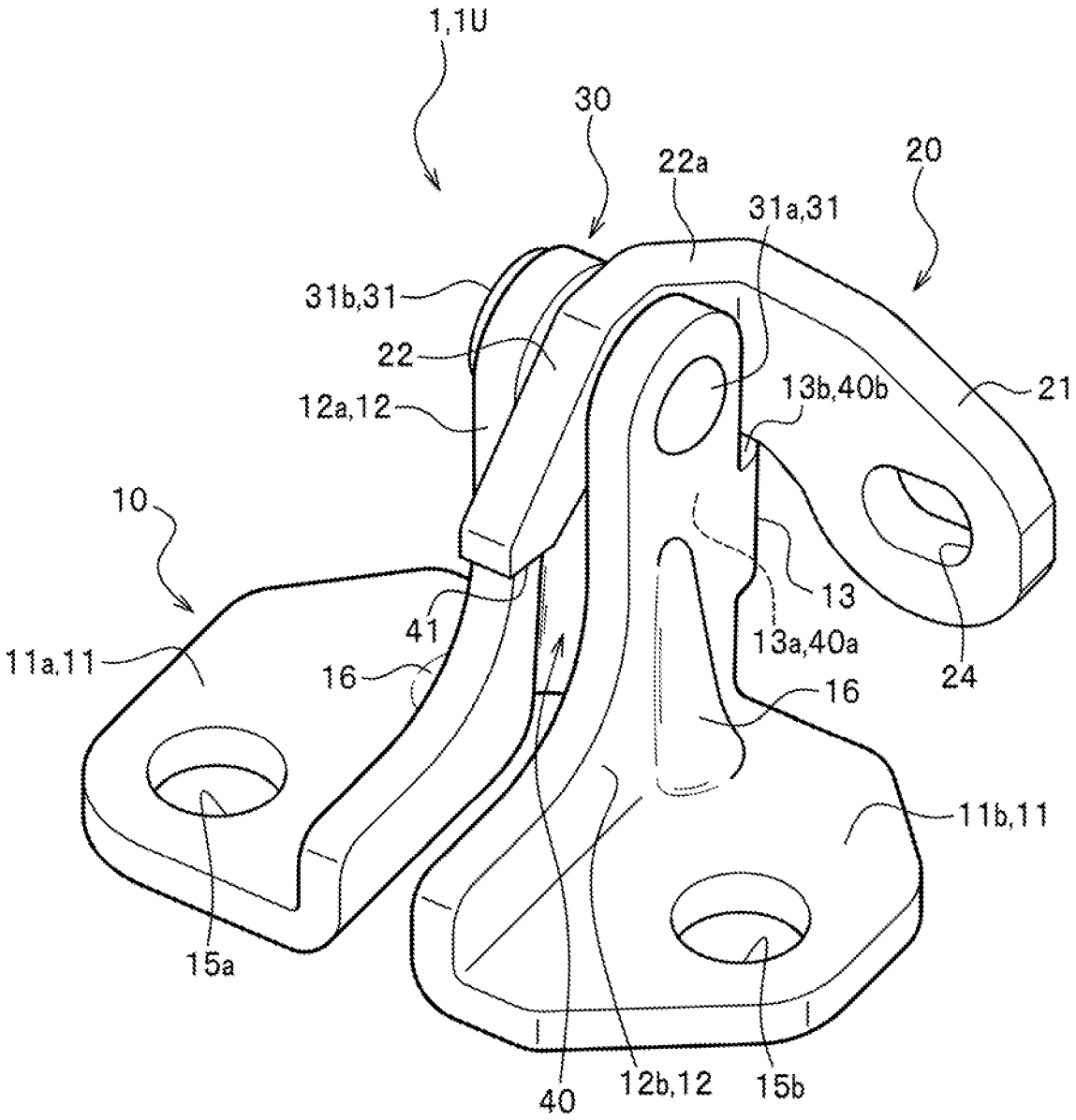
FIG. 7 is a perspective view showing an upper hinge mechanism according to a second embodiment.

As shown in FIG. 7, the second embodiment largely differs from the first embodiment in the shape of the standing leg section 12 and in the shape of the vehicle body side attachment section 11.

In the standing leg section 12 of the second embodiment, a bead 16 is formed on both the upper standing leg portion 12*a* (first standing leg portion) and the lower standing leg portion 12*b* (second standing leg portion).

The bead 16 is a protrusion formed by press working (bending). The bead 16 of the upper standing leg portion 12*a* protrudes from a plate surface thereof along a direction in which the upper standing leg portion 12*a* extends at a substantially right angle from the vehicle body side upper attachment portion 11*a*. The bead 16 of the lower standing leg portion 12*b* protrudes from a plate surface thereof along a direction in which the lower standing leg portion 12*b* extends at a substantially right angle from the vehicle body side lower attachment portion 11*b*.

Next, a description will be given of the vehicle body side attachment section 11. In the first embodiment, the upper vehicle body side attachment portion 11*a* and the lower vehicle body side attachment portion 11*b* each have a substantially rectangular shape. However, they may instead have a substantially trapezoid shape with rounded corners as shown in FIG. 7. Moreover, in the second embodiment, the vehicle body side upper attachment portion 11*a* and the vehicle body side lower attachment portion 11*b* have different trapezoid shapes from each other.

Further, the upper fixing hole 15*a* and the lower fixing hole 15*b* are located at locations different from those in the first embodiment. Specifically, the distance La from the center O15*a* of the upper fixing hole 15*a* to the hinge axis L31 is different from the distance Lb from the center O15*b* of the lower fixing hole 15*b* to the hinge axis L31; and a distance Lc from the center O15*a* to a lower lengthwise side of the trapezoid shape of the vehicle body side upper attachment portion 11*a* is different from a distance Ld from the center O15*b* to an upper lengthwise side of the trapezoid shape of the vehicle body side lower attachment portion 11*b*.

Next, a description will be given of advantageous effects of the hinge mechanism 1 according to the second embodiment.

In the second embodiment, the bead 16, which protrudes from a plate surface of the standing leg portion along a direction in which the standing leg portion extends at a substantially right angle from the corresponding attachment portion, is formed on each of the upper standing leg portion 12*a* and the lower standing leg portion 12*b*.

This structure increases rigidity of each of the upper standing leg portion 12*a* and the lower standing leg portion 12*b*, reduces flexural deformation that may be caused when opening or closing the door S2, and makes the pivoting in the pivot structure 30 smooth.

The beads 16 of the second embodiment are formed by press working (bending) the plate surfaces of the upper standing leg portion 12*a* and the lower standing leg portion 12*b* to be curved or bulged.

In this way, the rigidity of the hinge mechanism 1 can be increased without increasing the weight of the hinge mechanism 1.

It should be noted that, although the beads 16 are each constituted by a protrusion formed by press working, they are not limited thereto. For example, a member like a diagonal beam may be welded on each of the upper standing leg portion 12*a* and the lower standing leg portion 12*b*. Even this configuration provides the same effect.

Moreover, the distance La (see FIG. 4) from the center O15*a* of the upper fixing hole 15*a* to the hinge axis L31, the distance Lb (see FIG. 4) from the center O15*b* of the lower fixing hole 15*b* to the hinge axis L31, the distance Lc from the center O15*a* to the lower lengthwise side of the trapezoid shape of the vehicle body side upper attachment portion 11*a*, and the distance Ld from the center O15*b* to the upper lengthwise side of the trapezoid shape of the vehicle body side lower attachment portion 11*b* can be set as appropriate. Moreover, depending on the locations of the upper fixing hole 15*a* and the lower fixing hole 15*b*, the shape of the vehicle body side upper attachment portion 11*a* and the shape of the vehicle body side lower attachment portion 11*b* can be modified.

In this way, in addition to the above-described advantageous effects of the first embodiment, the load applied to the vehicle body side hinge member 10 when the door is opened or closed can be received at a more appropriate position.

What is claimed is:

1. A hinge mechanism comprising:

a structure side hinge member comprising a first attachment portion and a second attachment portion, wherein the structure side hinge member is attached to a vehicle body via the first attachment portion and the second attachment portion;

an opening and closing side hinge member attached to a door of the body; and a pivot structure that pivotably supports the structure side hinge member and the opening and closing side hinge member so that the structure side hinge member and the opening and closing side hinge member are allowed to pivot relative to each other, wherein the structure side hinge member is made of a single plate-like member, and wherein the pivot structure is located between the first attachment portion and the second attachment portion, wherein the structure side hinge member further comprises:

a first standing leg portion that extends at a substantially right angle from the first attachment portion, a second standing leg portion that extends at a substantially right angle from the second attachment portion, and a connection portion that traverses a pivoting range of the opening and closing side hinge member and connects between the first standing leg portion and the second standing leg portion, and wherein the opening and closing side hinge member includes a door side attachment portion and a pivot arm, the door side attachment portion being attached to the door, wherein the pivot structure comprises a hinge pin passing through the opening and closing side hinge member and having opposite ends supported by the first standing leg portion and the second standing leg portion, the hinge pin pivotably supporting the pivot arm, wherein the opening and closing side hinge member has a substantially L shape defined by the door side attachment portion and the pivot arm, and wherein the pivot arm abuts a pivot structure side surface of the connection portion from a vehicle width direction outer side thereof when the door is closed, thereby restricting further pivoting of the door in a closing direction thereof.

2. The hinge mechanism of claim 1, wherein the door side attachment portion extends substantially perpendicularly to the pivot arm and substantially in parallel with a central axis of the hinge pin, and wherein the pivot arm is oriented horizontally with respect to the door.

3. The hinge mechanism of claim 2, wherein the connection portion includes a U-shaped portion having a U-shaped cross section, and wherein the pivot arm abuts an inner surface of the U-shaped portion of the connection portion when the door is fully opened, thereby restricting further pivoting of the door in an opening direction thereof.

4. The hinge mechanism of claim 3, wherein at least one of the first standing leg portion and the second standing leg portion comprises a bead constituted by a protrusion that protrudes from a plate surface of the at least one of the first standing leg portion and the second standing leg portion along a direction in which the at least one of the first standing leg portion and the second standing leg portion extends at a substantially right angle from corresponding one of the first attachment portion and the second attachment portion.

5. The hinge mechanism of claim 4, further comprising:

a first fixing means for fixing the first attachment portion to the vehicle body; and a second fixing means for fixing the second attachment portion to the vehicle body, wherein, in plan view, the first fixing means and the second fixing means are located so that a distance from a central axis of the hinge pin to a center of the first fixing means is the same as a distance from the central axis of the hinge pin to a center of the second fixing means.

6. The hinge mechanism of claim 4, further comprising:

a first fixing means for fixing the first attachment portion to the vehicle body; and a second fixing means for fixing the second attachment portion to the vehicle body, wherein, in plan view, the first fixing means and the second fixing means are located so that a center of the first fixing means and a center of the second fixing means are on a line extending along the central axis of the hinge pin.

7. The hinge mechanism of claim 3, further comprising:

a first fixing means for fixing the first attachment portion to the vehicle body; and a second fixing means for fixing the second attachment portion to the vehicle body, wherein, in plan view, the first fixing means and the second fixing means are located so that a distance from a central axis of the hinge pin to a center of the first fixing means is the same as a distance from the central axis of the hinge pin to a center of the second fixing means.

8. The hinge mechanism of claim 3, further comprising:

a first fixing means for fixing the first attachment portion to the vehicle body; and a second fixing means for fixing the second attachment portion to the vehicle body, wherein, in plan view, the first fixing means and the second fixing means are located so that a center of the first fixing means and a center of the second fixing means are on a line extending along the central axis of the hinge pin.

9. The hinge mechanism of claim 2, wherein at least one of the first standing leg portion and the second standing leg portion comprises a bead constituted by a protrusion that protrudes from a plate surface of the at least one of the first standing leg portion and the second standing leg portion along a direction in which the at least one of the first standing leg portion and the second standing leg portion extends at a substantially right angle from corresponding one of the first attachment portion and the second attachment portion.

10. The hinge mechanism of claim 2, further comprising:

a first fixing means for fixing the first attachment portion to the vehicle body; and a second fixing means for fixing the second attachment portion to the vehicle body, wherein, in plan view, the first fixing means and the second fixing means are located so that a distance from a central axis of the hinge pin to a center of the first fixing means is the same as a distance from the central axis of the hinge pin to a center of the second fixing means.

11. The hinge mechanism of claim 2, further comprising:

a first fixing means for fixing the first attachment portion to the vehicle body; and a second fixing means for fixing the second attachment portion to the vehicle body, wherein, in plan view, the first fixing means and the second fixing means are located so that a center of the first fixing means and a center of the second fixing means are on a line extending along the central axis of the hinge pin.

12. The hinge mechanism of claim 9, further comprising:

a first fixing means for fixing the first attachment portion to the vehicle body; and a second fixing means for fixing the second attachment portion to the vehicle body, wherein, in plan view, the first fixing means and the second fixing means are located so that a distance from a central axis of the hinge pin to a center of the first fixing means is the same as a distance from the central axis of the hinge pin to a center of the second fixing means.

13. The hinge mechanism of claim 9, further comprising:

a first fixing means for fixing the first attachment portion to the vehicle body; and a second fixing means for fixing the second attachment portion to the vehicle body, wherein, in plan view, the first fixing means and the second fixing means are located so that a center of the first fixing means and a center of the second fixing means are on a line extending along the central axis of the hinge pin.

14. The hinge mechanism of claim 1, wherein the connection portion includes a U-shaped portion having a U-shaped cross section, and wherein the pivot arm abuts an inner surface of the U-shaped portion of the connection portion when the door is fully opened, thereby restricting further pivoting of the door in an opening direction thereof.

15. The hinge mechanism of claim 14, wherein at least one of the first standing leg portion and the second standing leg portion comprises a bead constituted by a protrusion that protrudes from a plate surface of the at least one of the first standing leg portion and the second standing leg portion along a direction in which the at least one of the first standing leg portion and the second standing leg portion extends at a substantially right angle from corresponding one of the first attachment portion and the second attachment portion.

16. The hinge mechanism of claim 1, wherein at least one of the first standing leg portion and the second standing leg portion comprises a bead constituted by a protrusion that protrudes from a plate surface of the at least one of the first standing leg portion and the second standing leg portion along a direction in which the at least one of the first standing leg portion and the second standing leg portion extends at a substantially right angle from corresponding one of the first attachment portion and the second attachment portion.

17. The hinge mechanism of claim 1, further comprising:

a first fixing means for fixing the first attachment portion to the vehicle body; and a second fixing means for fixing the second attachment portion to the vehicle body, wherein, in plan view, the first fixing means and the second fixing means are located so that a distance from a central axis of the hinge pin to a center of the first fixing means is the same as a distance from the central axis of the hinge pin to a center of the second fixing means.

18. The hinge mechanism of claim 1, further comprising:

a first fixing means for fixing the first attachment portion to the vehicle body; and a second fixing means for fixing the second attachment portion to the vehicle body, wherein, in plan view, the first fixing means and the second fixing means are located so that a center of the first fixing means and a center of the second fixing means are on a line extending along the central axis of the hinge pin.

* * * * *